US007896205B1

(12) United States Patent
Gonzalez et al.

(10) Patent No.: US 7,896,205 B1
(45) Date of Patent: Mar. 1, 2011

(54) DRINK CARRIER SYSTEM

(76) Inventors: Kelvin Gonzalez, Miami, FL (US); Evelyn Pichardo-Gonzalez, Miami, FL (US)

( * ) Notice: Subject to any disclaimer, the term of this patent is extended or adjusted under 35 U.S.C. 154(b) by 467 days.

(21) Appl. No.: 12/074,774

(22) Filed: Mar. 6, 2008

(51) Int. Cl.
*A45F 3/16* (2006.01)
*A45F 3/14* (2006.01)
*A45F 5/00* (2006.01)

(52) U.S. Cl. ..... 224/148.6; 224/148.1; 224/250; 224/257; 224/258; 224/270; 224/906

(58) Field of Classification Search ..... 224/148.1, 224/148.6, 250, 257, 258, 270, 906
See application file for complete search history.

(56) References Cited

U.S. PATENT DOCUMENTS 2,153,391 A * 4/1939 Projansky ..... 294/27.1
3,061,390 A * 10/1962 Walshel et al. ..... 108/43
3,468,467 A * 9/1969 Amberg ..... 229/403
4,754,903 A * 7/1988 Dennis ..... 224/148.5
4,915,278 A * 4/1990 Smith ..... 224/601
4,966,297 A * 10/1990 Doty ..... 220/23.83
4,985,932 A * 1/1991 Bezdek ..... 2/49.2
5,062,558 A * 11/1991 Stang ..... 224/270
5,390,838 A * 2/1995 Jafarkhani ..... 224/148.4
5,454,497 A * 10/1995 Kettelson ..... 224/148.6
5,649,654 A * 7/1997 Hayward, Jr. ..... 224/270
5,850,911 A * 12/1998 Pakzad ..... 206/217
6,619,810 B2 * 9/2003 Kramer et al. ..... 362/84

FOREIGN PATENT DOCUMENTS

JP 07155248 A * 6/1995
JP 2005035635 A * 2/2005

* cited by examiner

*Primary Examiner*—Nathan J Newhouse
*Assistant Examiner*—Lester L Vanterpool

(57) ABSTRACT

A carrier is in a generally three dimensional trapezoid-like configuration. The carrier has a closed square lower bottom. The carrier has an open square upper top. The carrier has four planar trapezoidal side walls.

9 Claims, 2 Drawing Sheets

DRINK CARRIER SYSTEM

BACKGROUND OF THE INVENTION

1. Field of the Invention

The present invention relates to a drink carrier system and more particularly pertains to holding and transporting hands free a cup with a beverage in a safe, convenient and economical manner.

2. Description of the Prior Art

The use of carriers of known designs and configurations is known in the prior art. More specifically, carriers of known designs and configurations previously devised and utilized for the purpose of carrying a container through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,454,497 issued Oct. 2, 1995 to Kettelson relates to a Hanging Beverage Container Carrier. U.S. Pat. No. 5,390,838 issued Feb. 21, 1995 to Jafarkhani relates to a Personal Beverage Cup Holder. Lastly, U.S. Pat. No. 4,915,278 issued Apr. 10, 1990 to Smith relates to a Portable Container.

While these devices fulfill their respective, particular objectives and requirements, the aforementioned patents do not describe a drink carrier system that allows for holding and transporting hands free a cup with a beverage in a safe, convenient and economical manner.

In this respect, the drink carrier system according to the present invention substantially departs from the conventional concepts and designs of the prior art, and in doing so provides an apparatus primarily developed for the purpose of holding and transporting hands free a cup with a beverage in a safe, convenient and economical manner.

Therefore, it can be appreciated that there exists a continuing need for a new and improved drink carrier system which can be used for holding and transporting hands free a cup with a beverage in a safe, convenient and economical manner. In this regard, the present invention substantially fulfills this need.

SUMMARY OF THE INVENTION

In view of the foregoing disadvantages inherent in the known types of carriers of known designs and configurations now present in the prior art, the present invention provides an improved drink carrier system. As such, the general purpose of the present invention, which will be described subsequently in greater detail, is to provide a new and improved drink carrier system and method which has all the advantages of the prior art and none of the disadvantages.

To attain this, the present invention essentially comprises a drink carrier system. First provided is a cup. The cup is in a generally conical configuration. The cup has a vertical central axis. The cup has a closed circular lower base. The cup has a strengthened open circular upper lip. The cup has an imperforate frusto-conical side wall 22. The side wall is provided between the base and the lip. The base has a diameter of between 2.000 inches and 3.500 inches, preferably 2.750 inches plus or minus 10 percent. The lip has a diameter of between 3.000 inches and 4.500 inches, preferably 3.500 inches plus or minus 10 percent. The side wall has a length of between 2.500 inches and 9.000 inches, preferably 4.750 inches plus or minus 10 percent. The side wall forms an angle with the base of between 8 degrees and 12 degrees, preferably about 10 degrees plus or minus 10 percent. The cup is fabricated of a liquid impervious, essentially rigid material. The liquid impervious, essentially rigid material is chosen from the class of liquid impervious, essentially rigid materials. The class of liquid impervious, essentially rigid materials includes styrofoam, rubber, plastic, and paper, coated and non-coated. The liquid impervious, essentially rigid material is preferably styrene foam. The cup is adapted to be fabricated directly into the final shape as by molding.

A carrier is provided. The carrier is in a generally three dimensional trapezoid-like configuration. The carrier has a vertical central axis. The vertical central axis of the carrier is coextensive with the vertical axis of the cup. The carrier has a closed square lower bottom. The carrier has an open square upper top. The carrier has four planar trapezoidal side walls. The side walls are provided between the bottom and the top. The bottom has a side length of between 1.000 inches and 3.000 inches, preferably 2.250 inches plus or minus 10 percent. The top has a side length of between 2.000 inches and 4.500 inches, preferably 3.500 inches plus or minus 10 percent. The side wall has a generally vertical height of between 2.000 inches and 7.000 inches, preferably about 3.500 inches plus or minus 10 percent. The side wall forms an angle with the bottom of between 8 degrees and 12 degrees, preferably 10 degrees plus or minus 10 percent. The carrier is fabricated of metal, cardboard or a liquid impervious, essentially rigid material. The liquid impervious, essentially rigid material is chosen from the class of liquid impervious, essentially rigid materials. The class of liquid impervious, essentially rigid material includes plastic, paper and styrene foam. The liquid impervious, essentially rigid material is preferably styrene foam. In an alternate embodiment of the invention, the carrier is fabricated of an illuminescent material for glow in the dark capabilities.

The carrier is adapted to securely support a cup with the base of the cup upon the bottom of the carrier. Four lines of contact are provided between the side wall of the cup and the side walls of the carrier. In this manner a finger is formed. Four receiving spaces are provided between the cup and the lines of contact between the various side walls of the carrier. The carrier is adapted to be fabricated directly into the final shape as by molding. In an alternate embodiment, the carrier may be fabricated into a flat configuration and then subsequently formed into its final shape.

Further provided is a flexible cord. The flexible cord is formed of a flexible, essentially inextensible material. The cord has first and second free ends. The cord has a length of between 3 feet and 6 feet, preferably 4 feet plus or minus 10 percent. The first free end is secured to one side of the carrier adjacent to the top. The second free end is secured to the opposite, non-contiguous side of the carrier adjacent to the top. In this manner the carrier, while removably supporting the cup with liquid, is adapted to be supported with the cord around a user's neck and/or shoulders and with the carrier touching a user's chest. The cord is adapted to be secured to the carrier in any number of ways including, but not limited to, gluing, passing through a hole with knotting, stapling and the like.

Provided last and optionally are indicia. The indicia are printed on at least one side wall of the carrier.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drink carrier system which has all of the advantages of the prior art carriers of known designs and configurations and none of the disadvantages.

It is another object of the present invention to provide a new and improved drink carrier system which may be easily and efficiently manufactured and marketed.

It is further object of the present invention to provide a new and improved drink carrier system which is of durable and reliable constructions.

An even further object of the present invention is to provide a new and improved drink carrier system which is susceptible of a low cost of manufacture with regard to both materials and labor, and which accordingly is then susceptible of low prices of sale to the consuming public, thereby making such drink carrier system economically available to the buying public.

Even still another object of the present invention is to provide a drink carrier system for holding and transporting hands free a cup with a beverage in a safe, convenient and economical manner.

Lastly, it is an object of the present invention to provide a new and improved drink carrier system. A carrier is in a generally three dimensional trapezoid-like configuration. The carrier has a closed square lower bottom. The carrier has an open square upper top. The carrier has four planar trapezoidal side walls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
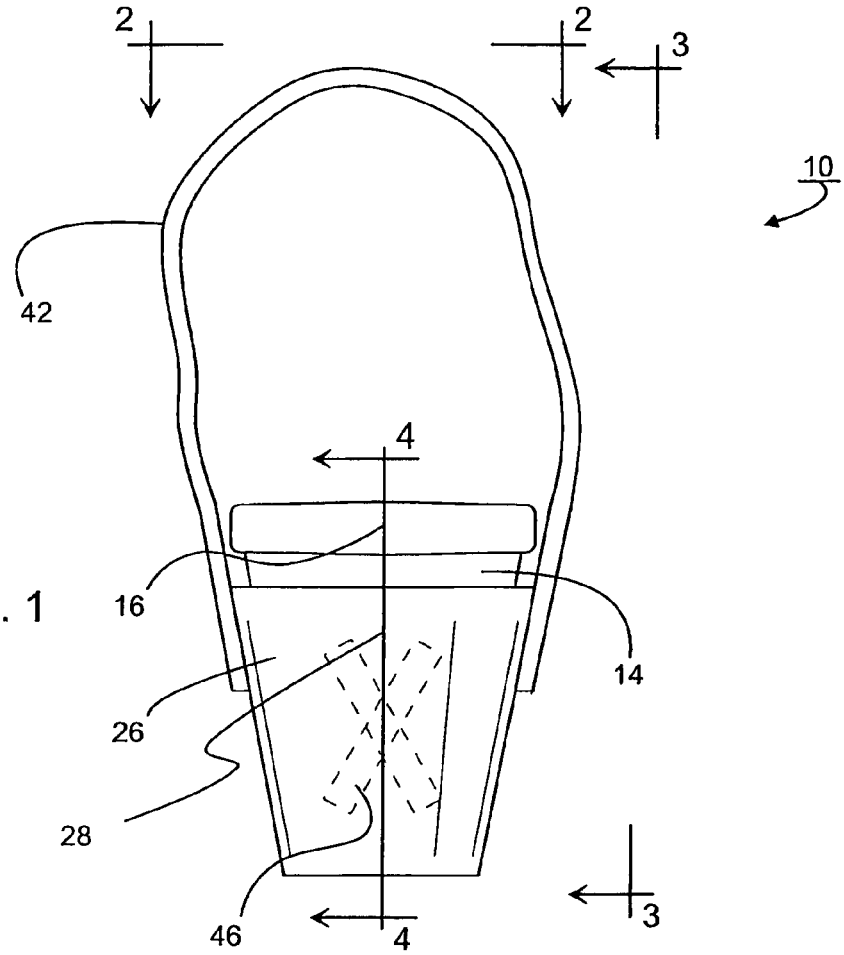
FIG. 1 is a front elevational view of a drink carrier system constructed in accordance with the principles of the present invention.
Figure 2:
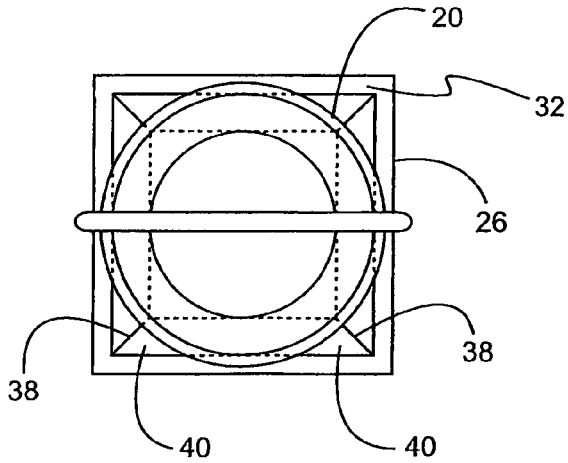
FIG. 2 is a plan view of the system taken along line 2-2 of FIG. 1.
Figure 3:
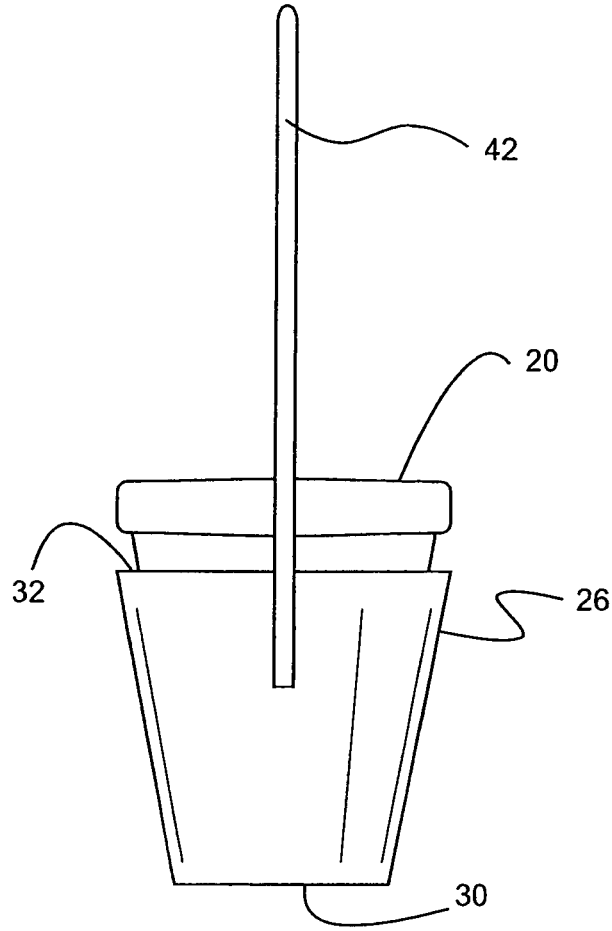
FIG. 3 is a side elevational view of the system taken along line 3-3 of FIG. 1.
Figure 4:
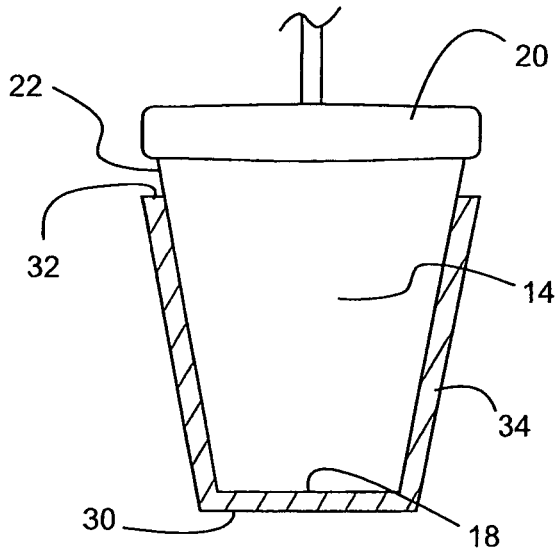
FIG. 4 is a cross sectional view of the system taken along line 4-4 of FIG. 1.

With reference now to the drawings, and in particular to FIG. 1 thereof, the preferred embodiment of the new and improved drink carrier system embodying the principles and concepts of the present invention and generally designated by the reference numeral 10 will be described.

The present invention, the drink carrier system 10 is comprised of a carrier configured so as to attain the desired objective.

First provided is a cup 14. The cup is in a generally conical configuration. The cup has a vertical central axis 16. The cup has a closed circular lower base 18. The cup has a strengthened open circular upper lip 20. The cup has an imperforate frusto-conical side wall 22. The side wall is provided between the base and the lip. The base has a diameter of between 2.000 inches and 3.500 inches, preferably 2.750 inches plus or minus 10 percent. The lip has a diameter of between 3.000 inches and 4.500 inches, preferably 3.500 inches plus or minus 10 percent. The side wall has a length of between 2.500 inches and 9.000 inches, preferably 4.750 inches plus or minus 10 percent. The side wall forms an angle with the base of between 8 degrees and 12 degrees, preferably about 10 degrees plus or minus 10 percent. The cup is fabricated of a liquid impervious, essentially rigid material. The liquid impervious, essentially rigid material is chosen from the class of liquid impervious, essentially rigid materials. The class of liquid impervious, essentially rigid materials includes styrofoam, rubber, plastic, and paper, coated and non-coated. The liquid impervious, essentially rigid material is preferably styrene foam. The cup is adapted to be fabricated directly into the final shape as by molding. In an alternate embodiment, the cup may be fabricated into a flat configuration and then subsequently formed into its final shape.

A carrier 26 is provided. The carrier is in a generally three dimensional trapezoid-like configuration. The carrier has a vertical central axis 28. The vertical central axis of the carrier is coextensive with the vertical axis of the cup. The carrier has a closed square lower bottom 30. The carrier has an open square upper top 32. The carrier has four planar trapezoidal side walls 34. The side walls are provided between the bottom and the top. The bottom has a side length of between 1.000 inches and 3.000 inches, preferably 2.250 inches plus or minus 10 percent. The top has a side length of between 2.000 inches and 4.5000 inches, preferably 3.500 inches plus or minus 10 percent. The side wall has a generally vertical height of between 2.000 inches and 7.000 inches, preferably about 3.500 inches plus or minus 10 percent. The side wall forms an angle with the bottom of between 8 degrees and 12 degrees, preferably 10 degrees plus or minus 10 percent. The carrier is fabricated of metal, cardboard or a liquid impervious, essentially rigid material. The liquid impervious, essentially rigid material is chosen from the class of liquid impervious, essentially rigid materials. The class of liquid impervious, essentially rigid material includes plastic, paper and styrene foam. The liquid impervious, essentially rigid material is preferably styrene foam. In an alternate embodiment of the invention, the carrier is fabricated of an illuminescent material for glow in the dark capabilities.

The carrier is adapted to securely support a cup with the base of the cup upon the bottom of the carrier. Four lines 38 of contact are provided between the side wall of the cup and the side walls of the carrier. In this manner a finger is formed. Four receiving spaces 40 are provided between the cup and the lines of contact between the various side walls of the carrier. The carrier is adapted to be fabricated directly into the final shape as by molding. In an alternate embodiment, the carrier may be fabricated into a flat configuration and then subsequently formed into its final shape.

In the preferred embodiment, each side length of the carrier bottom is between 60 and 70 percent of the length of the side wall of the cup. Further, each side length of the carrier bottom is between 45 and 55 percent of the length of each side wall of the carrier.

Further provided is a flexible cord 42. The flexible cord is formed of a flexible, essentially inextensible material. The cord has first and second free ends 40. The cord has a length of between 3 feet and 6 feet, preferably 4 feet plus or minus 10 percent. The first free end is secured to one side of the carrier adjacent to the top. The second free end is secured to the opposite, non-contiguous side of the carrier adjacent to the top. In this manner the carrier, while removably supporting the cup with liquid, is adapted to be supported with the cord around a use's neck and/or shoulders and with the carrier touching a user's chest. The cord is adapted to be secured to the carrier in any number of ways including, but not limited to, gluing, passing through a hole with knotting, stapling and the like.

Provided last and optionally are indicia 46. The indicia may be printed on at least one side wall of the carrier. In an alternate embodiment of the invention, indicia are adapted to be printed on a plurality of side walls, preferably on all four side walls, of the carrier.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drink carrier system comprising:

a carrier in a generally three dimensional trapezoid-like configuration formed with a closed square lower bottom and an open square upper top and with four planar trapezoidal side walls, the square upper top and the closed square lower bottom being spaced by a carrier height, the side walls forming a carrier angle with the lower bottom; and a cup in a generally conical configuration having a vertical central axis, the cup being formed with a closed circular lower base and a strengthened open circular upper lip and with an imperforate frusto-conical side wall between the base and the lip, the side wall forming a cup angle with respect to the circular lower base essentially equal to the carrier angle, the cup height being greater than the carrier height.

2. The system as set forth in claim 1 wherein the bottom has a side length 2.250 inches plus or minus 10 percent, the top has a side length of 3.500 inches plus or minus 10 percent, and the side walls have a generally vertical height of about 3.500 inches plus or minus 10 percent, and wherein the side walls form an angle with the bottom of 10 degrees plus or minus 10 percent, and wherein the carrier is adapted to securely support a cup.

3. The system as set forth in claim 2 wherein each side length of the carrier bottom is between 45 and 55 percent of the length of each side wall of the carrier.

4. The system as set forth in claim 1 wherein the cup is fabricated of styrene foam.

5. The system as set forth in claim 4 wherein each side length of the carrier bottom is between 60 and 70 percent of the length of the side wall of the cup.

6. The system as set forth in claim 1 and further including:

a flexible cord formed of a flexible, essentially inextensible material with first and second free ends 40, the cord having a length of 4 feet plus or minus 10 percent, the first free end being secured to one side of the carrier adjacent to the top and the second free end being secured to the opposite, non-contiguous side of the carrier adjacent to the top whereby the carrier, while removably supporting the cup with liquid, is adapted to be supported with the cord around a use's neck and/or shoulders and with the carrier touching a user's chest.

7. The system as set forth in claim 1 and further including:

indicia, optionally printed, on at least one side wall of the carrier.

8. The system as set forth in claim 1 wherein the carrier is fabricated of an illuminescent material for glow in the dark capabilities.

9. A drink carrier system for holding and transporting hands free a cup with a beverage in a safe, convenient and economical manner, comprising, in combination:

a cup in a generally conical configuration having a vertical central axis, the cup being formed with a closed circular lower base and a strengthened open circular upper lip and with an imperforate frusto-conical side wall between the base and the lip, the base having a diameter of between 2.000 inches and 3.500 inches, the lip having a diameter Of between 3.000 inches and 4.500 inches, the side wall having a length of between 2.500 inches and 9.000 inches, the side wall forming an angle with the base of between 8 degrees and 12 degrees, the cup being fabricated of a liquid impervious, essentially rigid material chosen from the class of liquid impervious, essentially rigid materials including styrofoam, rubber, plastic, and paper, coated and non-coated;

a carrier in a generally three dimensional trapezoid-like configuration having a vertical central axis coextensive with the vertical axis of the cup, the carrier being formed with a closed square lower bottom and an open square upper top and with four planar trapezoidal side walls between the bottom and the top, the bottom having a side length of between 1.000 inches and 3.000 inches, the top having a side length of between 2.000 inches and 4.500 inches, the side wall having a generally vertical height of between 2.000 inches and 7.000 inches, the side wall forming an angle with the bottom of between 8 degrees and 12 degrees, the carrier being fabricated of a metal, cardboard or a liquid impervious, essentially rigid material chosen from the class of liquid impervious, essentially rigid materials including plastic, paper and styrene foam, the carrier adapted to securely support a cup with the base of the cup upon the bottom of the carrier and with four lines of contact between the side wall of the cup and the side walls of the carrier thus forming a finger with four receiving spaces between the cup and the lines of contact between the various side walls of the carrier;

a flexible cord formed of a flexible, essentially inextensible material with first and second free ends, the cord having a length of between 3 feet and 6 feet the first free end being secured to one side of the carrier adjacent to the top and the second free end being secured to the opposite, non-contiguous side of the carrier adjacent to the top whereby the carrier, while removably supporting the cup with liquid, is adapted to be supported with the cord around a use's neck and/or shoulders and with the carrier touching a user's chest; and indicia optionally printed on at least one side wall of the carrier.

* * * * *